US008985490B2

(12) United States Patent
Dorsch et al.

(10) Patent No.: US 8,985,490 B2
(45) Date of Patent: Mar. 24, 2015

(54) CHOPPER PUMP WITH CUTTING INSERTS

(75) Inventors: Glenn R. Dorsch, Aberdeen, WA (US); Kent H. Keeran, Elma, WA (US); Rich Ballou, Montesano, WA (US); Alex Cahoon, Tumwater, WA (US)

(73) Assignee: Vaughan Company, Inc., Montesano, WA (US)

( * ) Notice: Subject to any disclaimer, the term of this patent is extended or adjusted under 35 U.S.C. 154(b) by 308 days.

(21) Appl. No.: 13/492,470

(22) Filed: Jun. 8, 2012

(65) Prior Publication Data

US 2012/0251319 A1 Oct. 4, 2012

Related U.S. Application Data

(63) Continuation-in-part of application No. 13/350,874, filed on Jan. 16, 2012, now Pat. No. 8,905,341, which is a continuation-in-part of application No. 12/220,829, filed on Jul. 29, 2008, now Pat. No. 8,105,017, application No. 13/492,470, which is a continuation-in-part of application No. 13/273,452, filed on Oct. 14, 2011, now Pat. No. 8,348,188, which is a continuation of application No. 12/721,602, filed on Mar. 11, 2010, now Pat. No. 8,118,244.

(51) Int. Cl.

| | |
|---|---|
| ***B02C 23/36*** | (2006.01) |
| ***F04D 7/04*** | (2006.01) |
| ***F04D 29/22*** | (2006.01) |

(52) U.S. Cl.

CPC ..... *F04D 7/045* (2013.01); *F04D 29/225* (2013.01); *F04D 29/2288* (2013.01)

USPC ..... 241/46.06

(58) Field of Classification Search

USPC ..... 241/46.06, 46.017; 415/121.1

See application file for complete search history.

(56) References Cited

U.S. PATENT DOCUMENTS

| | | | | |
|---|---|---|---|---|
| 5,460,482 | A * | 10/1995 | Dorsch | 415/121.1 |
| 7,125,221 | B2 * | 10/2006 | Dorsch et al. | 415/121.1 |
| 8,105,017 | B2 * | 1/2012 | Dorsch et al. | 415/121.1 |

* cited by examiner

*Primary Examiner* — Mark Rosenbaum

(74) *Attorney, Agent, or Firm* — Bishop Diehl & Lee, Ltd.

(57) ABSTRACT

A chopper pump with scissoring back cutters and having a housing with an intake opening and an outlet opening, both in fluid communication with an internal chamber, and an impeller assembly positioned within the chamber, is disclosed. Generally speaking, the impeller assembly comprises an impeller attached to a rotatable pump shaft and includes a back shroud. An insert cutter positioned on a surface of the shroud opposite the impeller includes a cutting edge configured for shearing operation, while a stationary back plate having a surface adjacent to and facing the back shroud includes a cutting rib having a cutting edge configured for shearing operation. The insert cutter and cutting rib work jointly to create a cutting action as the impeller in the chamber.

19 Claims, 12 Drawing Sheets

CHOPPER PUMP WITH CUTTING INSERTS

RELATED APPLICATIONS

The present application is a continuation-in-part of and claims priority to U.S. patent application Ser. No. 13/350,874, filed Jan. 16, 2012 and titled "Screw-Type Centrifugal Pump With Cutting Inserts," which is a continuation in part of U.S. patent application Ser. No. 12/220,829, filed Jul. 29, 2008 and titled "Centrifugal Chopper Pump with Impeller Assembly," now U.S. Pat. No. 8,105,017. The present application is also a continuation-in-part of U.S. patent application Ser. No. 13/273,452, filed on Oct. 14, 2011 and titled "Internal Cutter on Submersed Mixer," which is a continuation of U.S. patent application Ser. No. 12/721,602, filed Mar. 11, 2010 and titled "Internal Cutter on Submersed Mixer," now U.S. Pat. No. 8,118,244. The '017 patent, the '452 application, and the '244 patent are all hereby incorporated by reference.

TECHNICAL FIELD OF THE INVENTION

The present device relates to centrifugal pumps used for pumping liquids and slurries containing solid matter, including various types of refuse, and for chopping the solid matter which may thereafter be processed for disposal. Particularly, the device relates to a chopper pump which both effectively allows the pump to continue working during heavy chopping, provides better efficiency, and effectively reduces wear on components due to the presence of grit-like material in the liquid.

BACKGROUND OF THE INVENTION

Generally speaking, U.S. Pat. No. 3,155,046 to Vaughan, issued Nov. 3, 1964, discloses a centrifugal pump having an open impeller with radial vanes. The vane edges adjacent to the pump inlet cooperate with sharpened edges of inlet apertures to cut stringy material or chunks entering the pump. Similarly, U.S. Pat. No. 3,973,866 to Vaughan, issued Aug. 10, 1976, and U.S. Pat. No. 4,842,479 to Dorsch, issued Jun. 27, 1989, disclose centrifugal pumps having impellers with vanes cooperating with inlet apertures to achieve a chopping or slicing action of solid material in a liquid or slurry being pumped. In the case of the pumps of U.S. Pat. No. 3,973,866 to Vaughan and U.S. Pat. No. 4,842,479 to Dorsch, however, semi-open impellers having radial shroud plates are used and external booster propellers may be provided to accelerate flow into the pump. The latter, when used, helps displace chunks of solid matter which become lodged in the inlet apertures and, at least in some instances, cuts solid matter prior to entry into the pump.

Other types of pumps having external cutters rotated with an impeller or propeller are shown in U.S. Pat. No. 2,714,354 to Farrand, issued Aug. 2, 1955; U.S. Pat. No. 3,325,107 to Peterson, issued Jun. 13, 1967; and French Patent No. 1.323.707, issued Mar. 1, 1962. U.S. Pat. No. 3,444,818 to Sutton, issued May 20, 1969, discloses another type of centrifugal pump having an internal impeller with vanes cooperating with the periphery of an inlet aperture to achieve a slicing action. In the Sutton construction, an outer "chopper member" has blades that wipe across the outer surface of the apertured intake plate to assist in chopping solid material to a size small enough to enter the intake aperture. Similarly, in the construction shown in British Patent No. 1,551,918, published Sep. 5, 1979, external blades sweep across small intake apertures to dislodge or gradually cut solid material clogging an intake aperture. In both the construction shown in the Sutton patent and the construction shown in the British patent, the external member is mounted so as to be moveable axially away from the intake plate if a hard obstruction is encountered.

Other types of pumps designed for pumping liquids or slurries containing solid materials are disclosed in Canadian Patent No. 729,917, issued Mar. 15, 1966; Schlesiger U.S. Pat. No. 3,340,812, issued Sep. 12, 1967; Elliott U.S. Pat. No. 4,527,947, issued Jul. 9, 1985; and Corkill U.S. Pat. No. 4,575,308, issued Mar. 11, 1986.

One of the problems with each of these devices is the occurrence of motor overloading during heavy chopping. Where the chopping is not efficient, the motor power increases causing the motor protection controls to trip the motor offline. When the motor goes offline, the chopping stops and operator intervention is required to place the motor back online. The chopping down-time, of course, detracts from the cost effectiveness of the process.

Another problem relates to excessive wear on the cutting parts over time. Fibrous material, such as hair and the like, tend to accumulate in the cutting area, particularly at the cutting parts. The fibrous material collects grit and sand causing the cutting parts to grind down prematurely. A cutter nut and cutter bar assembly at the pump intake has been used to keep the cutting parts clear of such fiber and debris.

Perhaps the most closely related device for this purpose is shown in U.S. Pat. No. 5,460,483 to Dorsch, issued Oct. 24, 1995. The Dorsch '483 patent illustrates a square cutter nut projection (60) in FIG. 12. FIG. 15 of Dorsch '483 better illustrates the cutting operation of the projection (60) as it passes fingers (41). However, such a configuration is not nearly as aggressive as the invention of the present disclosure.

It is therefore desirable to provide a cutter assembly which helps maintain a clear cutting area, reduces cutting part wear and improves chopping efficiency to reduce motor power load and chopping down-time. It also would be desirable to provide a cutter assembly which aggressively reduces the build-up and collection of grit in the cutting area. The disclosed device affords other structural, manufacture and operating efficiencies not seen in prior art devices, as well.

SUMMARY OF THE INVENTION

There is disclosed herein an improved centrifugal chopper pump design which avoids the disadvantages of prior devices while affording additional structural and operating advantages.

Generally speaking, the disclosed centrifugal pump comprises a housing having an intake opening and an outlet opening, both in fluid communication with an internal chamber, and an impeller assembly positioned within the chamber.

In an embodiment of the system, the impeller assembly comprises an impeller having a back shroud, an insert cutter positioned on the back shroud to extend in a direction opposite the impeller and having a cutting edge configured for shearing operation, a stationary back plate having a surface adjacent to and facing the back shroud, and a cutting rib attached to the back plate surface and having a cutting edge configured for shearing operation.

In operation, the cutting edge of the insert cutter and the cutting edge of the cutting rib are angled and gapped relative to one another to create a cutting action as the insert cutter passes the cutting rib.

In various embodiments, the cutting rib is aligned radially on the surface of the back plate and a gap between the cutting rib and the insert cutter is preferably in the range of from about 0.005 to 0.050 inches, most preferably in the range of from about 0.010 to about 0.015 inches. Preferably, the insert cutter and the cutting rib are removable and means may be provided to permit the gap to be adjusted, as necessary.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
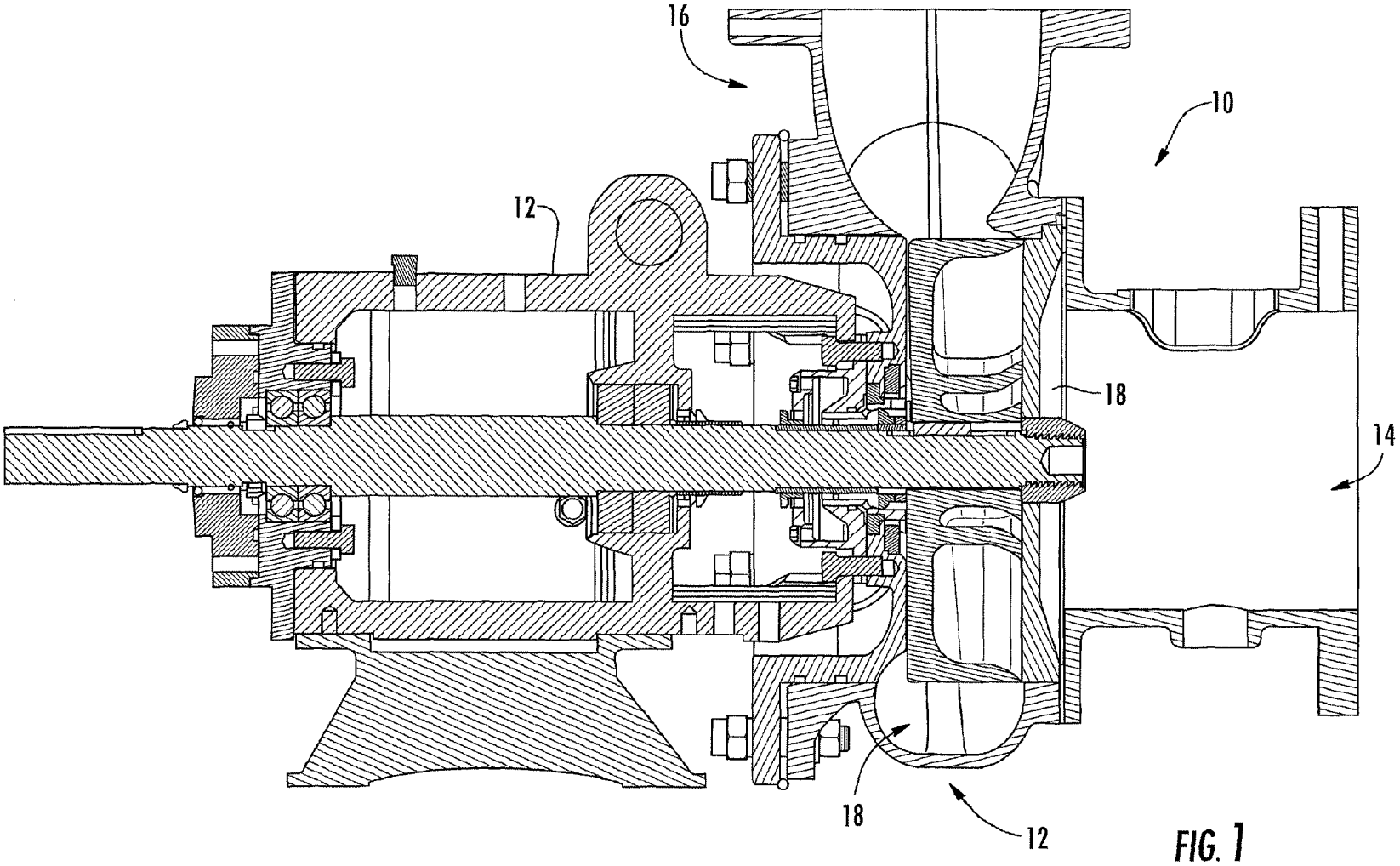
FIG. 1 is a side elevation of an installation of a centrifugal chopper pump in accordance with an embodiment of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-18, there is illustrated in the several views a chopper pump, generally designated by the numeral 10, and various components of pump 10. The chopper pump 10 has a housing 12 having an intake opening 14 and an outlet opening 16, both in fluid communication with an internal chamber 18. A similar chopper pump is illustrated and disclosed in U.S. Pat. No. 5,460,482 to Dorsch, the patent being assigned to the Assignee of the present invention. To the extent an understanding of the construction and operation of the present invention is aided by the '482 patent, the same is hereby incorporated by reference.

Figure 2:
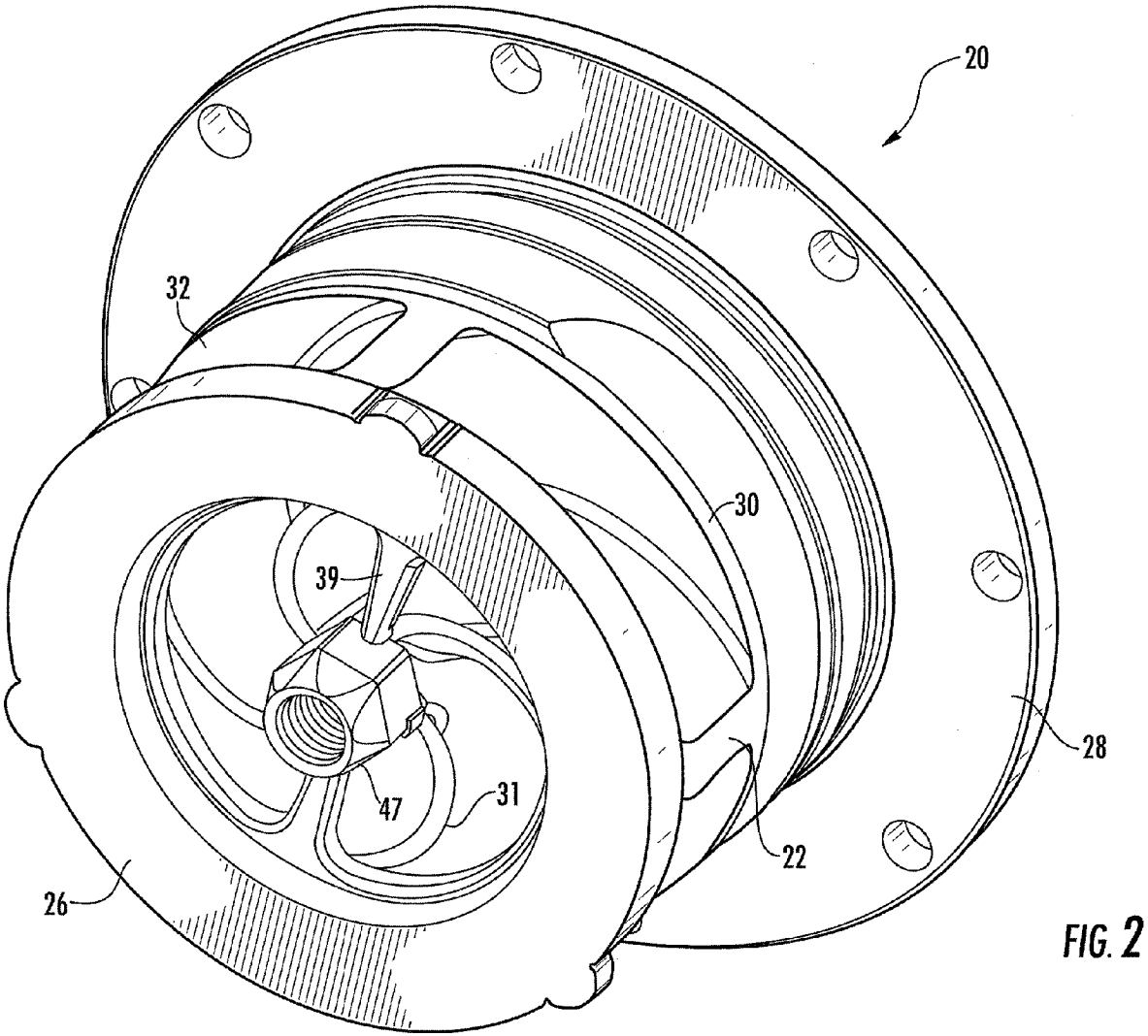
FIG. 2 is a perspective view of an impeller assembly in accordance with an embodiment of the present invention.
Figure 3:
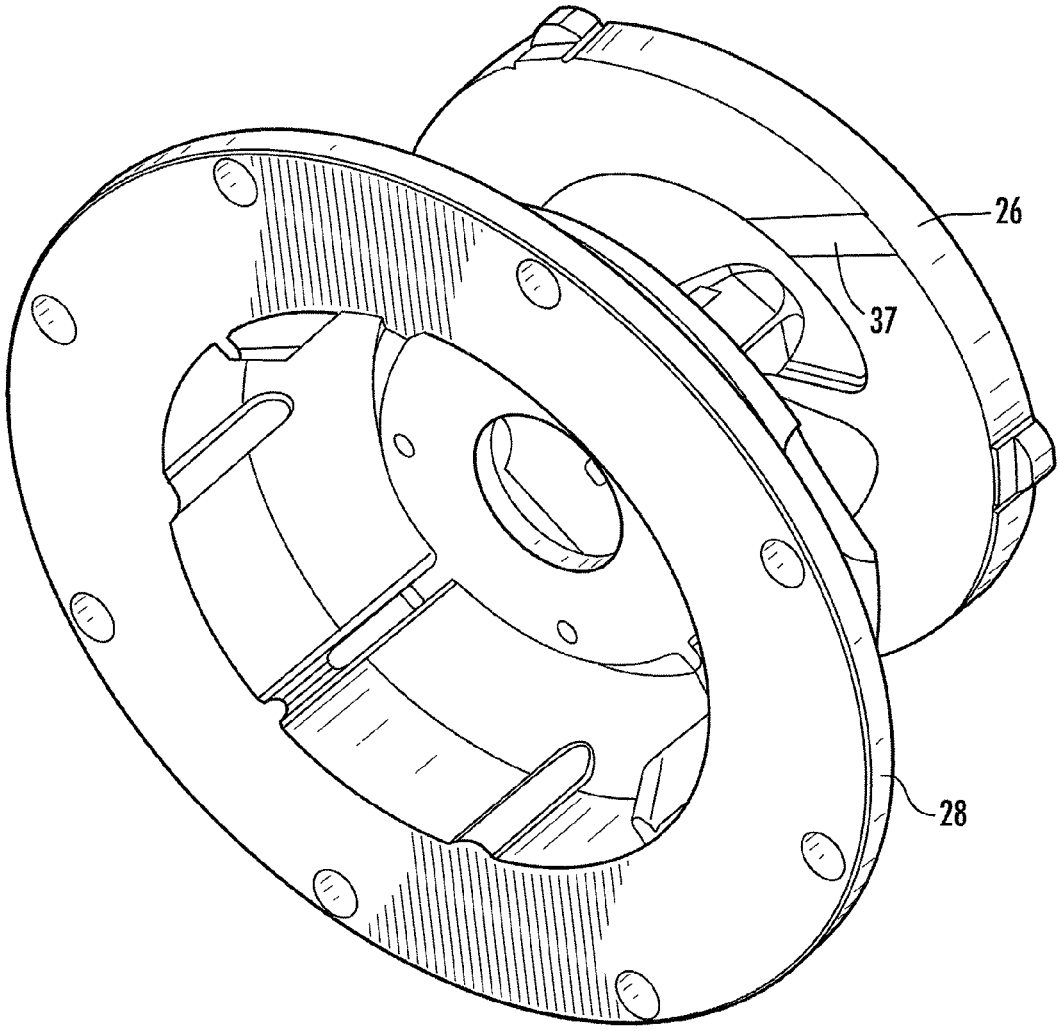
FIG. 3 is a perspective view of an internal cutter groove located on the cutter bar plate.

As shown in drawing FIGS. 1 and 2, positioned within the chamber 18 of the chopper pump 10 is an impeller assembly 20. Generally speaking, the impeller assembly 20 comprises an impeller 22, a cutter bar plate (also referred to as an end plate or a suction plate) 26 and a back plate 28. The impeller 22 is preferably a semi-open impeller design having a back shroud 30 onto which the blades 31 and an insert cutter 24 are fixed. The impeller cutting blades 31, of which four are shown but any number of blades may be possible, are radially arranged on a first surface 32 of the back shroud 30, extending outward from a central hub 33 to the surface edge. The blades 31 are preferably kept sharpened along the top edge 34 as these blades 31 are the first and primary cutting source for the chopper pump 10.

Referring to FIGS. 2-12, further components of the impeller assembly 20 can be more readily understood. At each end of the impeller 22 is a plate. A cutter bar plate 26 (a.k.a. end or suction plate) having an internal cutter groove 37 is positioned in proximity to and facing the impeller 22 at the inlet end of the chamber 18. The cutter groove 37, which is positioned radially just off-center on the cutter bar plate 26, along with the shear fingers 39 of the cutter bar plate 26 and the tooth of the cutter nut 47, operate in cooperation with the impeller blades 31 to comprise a cutting zone on the chopper pump 10. These components cooperate with the revolving impeller blades 31 to create a shearing action on any solid material in the fluid.

The use of a cutter groove 37 on the cutter bar plate 26 is an optional feature of the present invention and need not be used in all cases. The cutter groove 37 is discussed more fully in U.S. Pat. No. 7,125,221, also assigned to the Assignee of this invention, the disclosure of which is hereby incorporated by reference.

Figure 13:
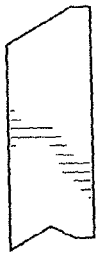
FIGS. 13-18 are various views of an embodiment of an insert cutter (FIGS. 13-15) and an embodiment of a cutting rib (FIG. 16-18).
Figure 14:
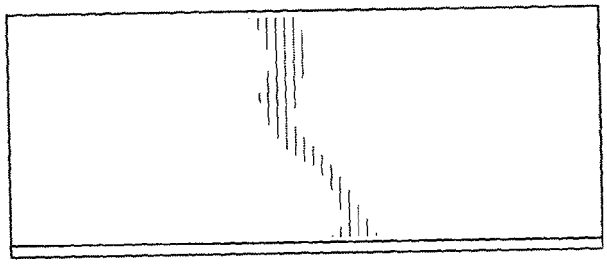
Figure 15:
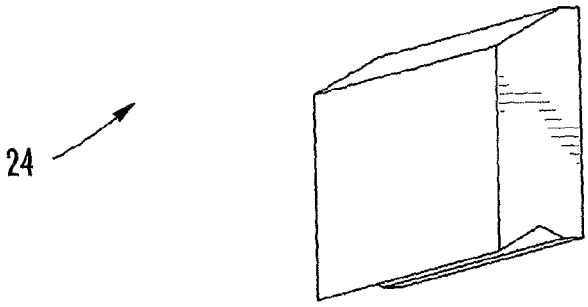
Figure 16:
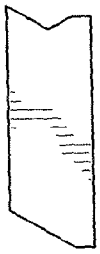
Figure 17:
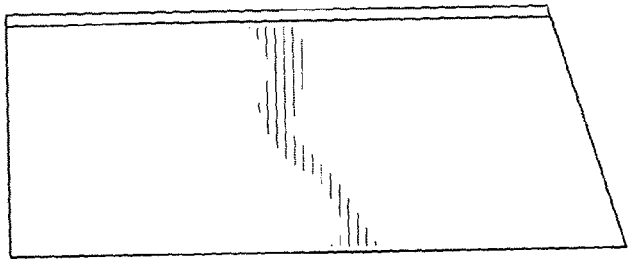
Figure 18:
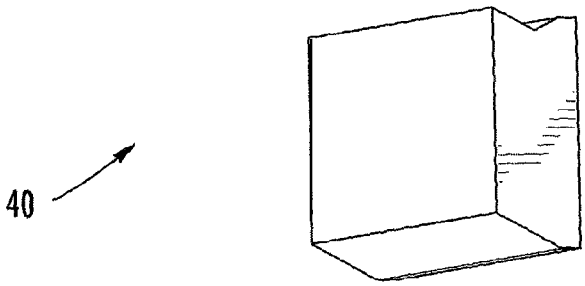

A unique aspect of the present invention is the use of two cutting inserts/ribs, shown in FIGS. 13-18, as they are positioned in the facing surfaces of the back plate 28 and back surface 35 of the shroud 30. As will be explained in greater detail below, the two cutting inserts/ribs cooperate to scissor material that infiltrates the area between the two surfaces and may threaten to wrap around the pump shaft. While the two cutting inserts/ribs may be very similar in design, as best illustrated in FIGS. 13 and 16, they are referenced herein as an insert cutter 24 on the back shroud 30 of the impeller 22 and as a cutting rib 40 on the back plate 28. This nomenclature helps to more readily understand the discussion which follows.

Figure 4:
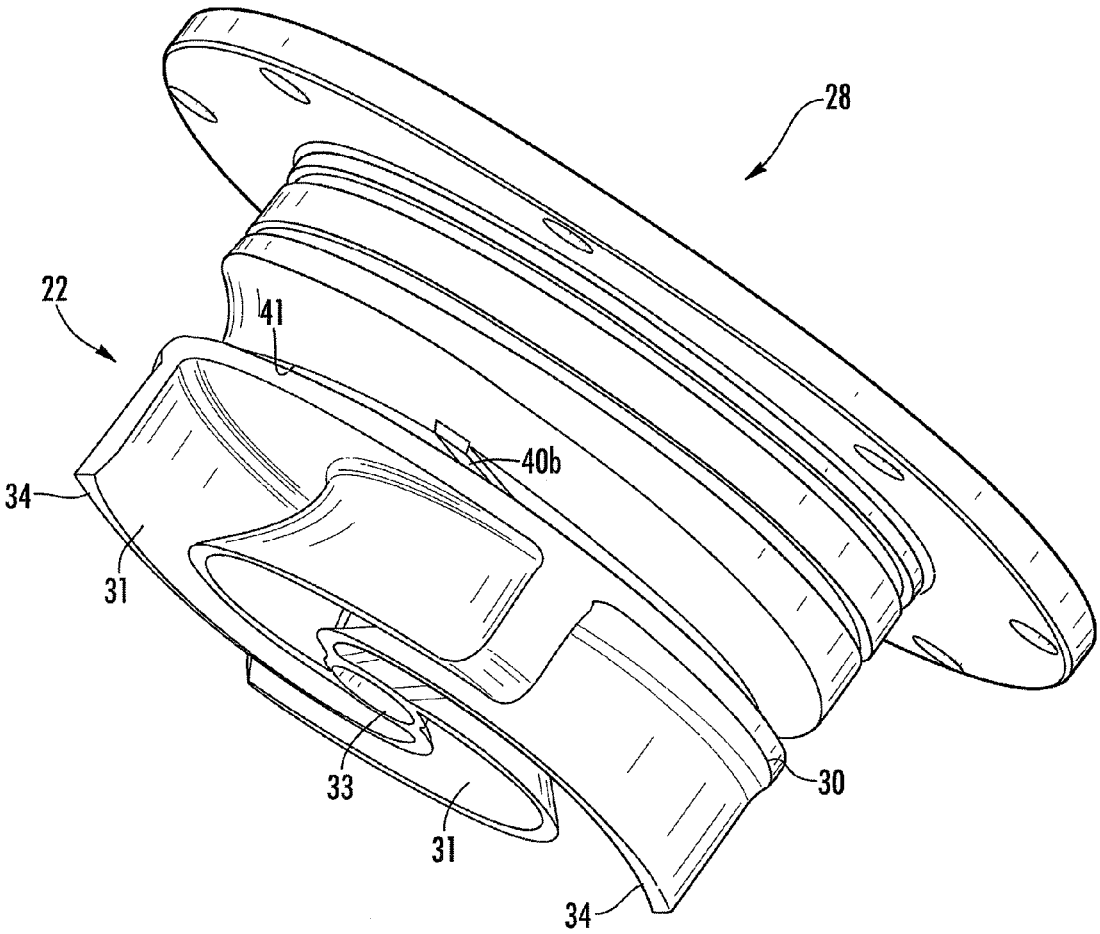
FIG. 4 is a side perspective view of an impeller and back plate in accordance with an embodiment of the present invention.
Figure 5:
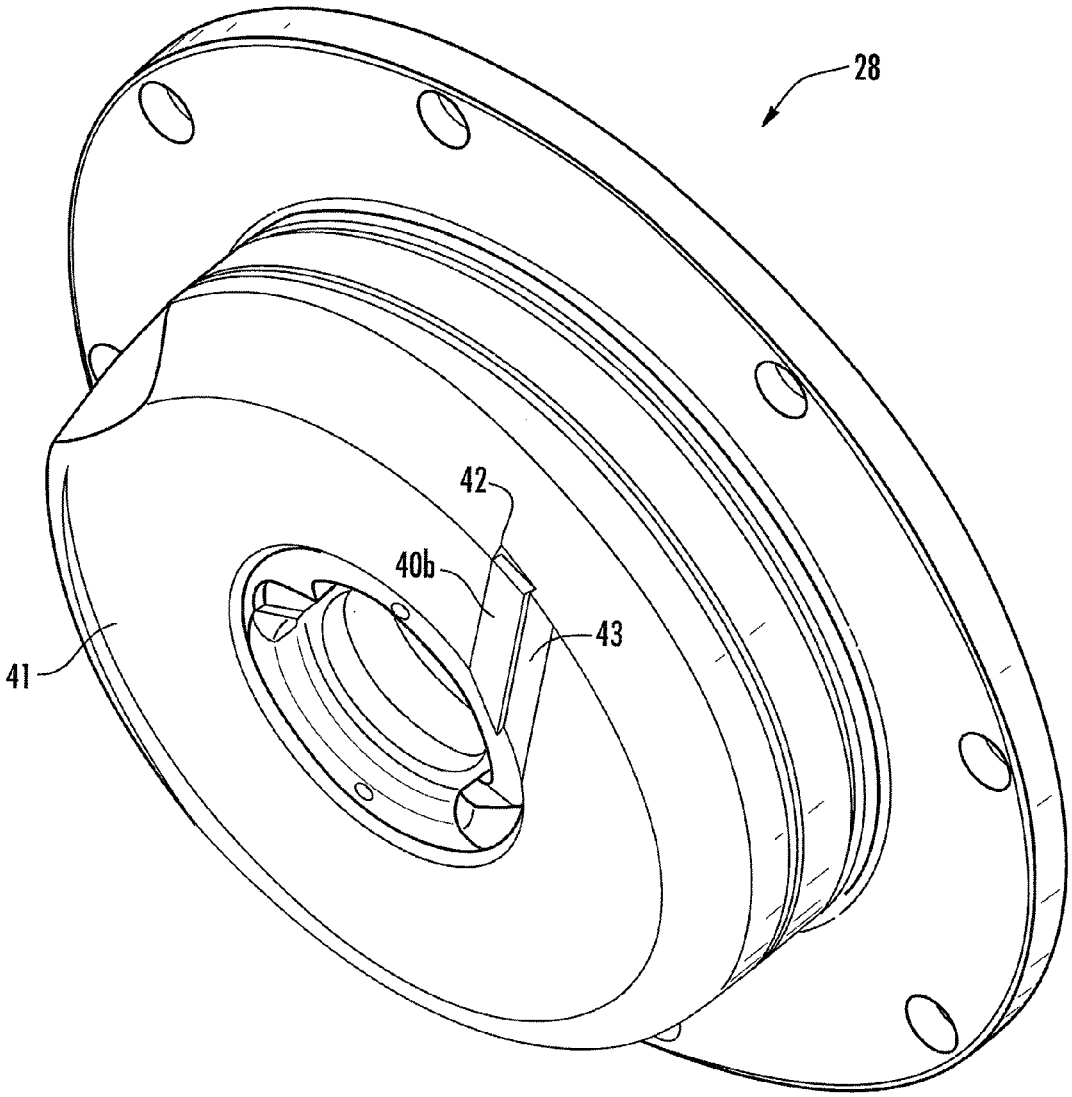
FIG. 5 is a perspective view of a back plate having a cutting rib in accordance with an embodiment of the present invention.
Figure 6:
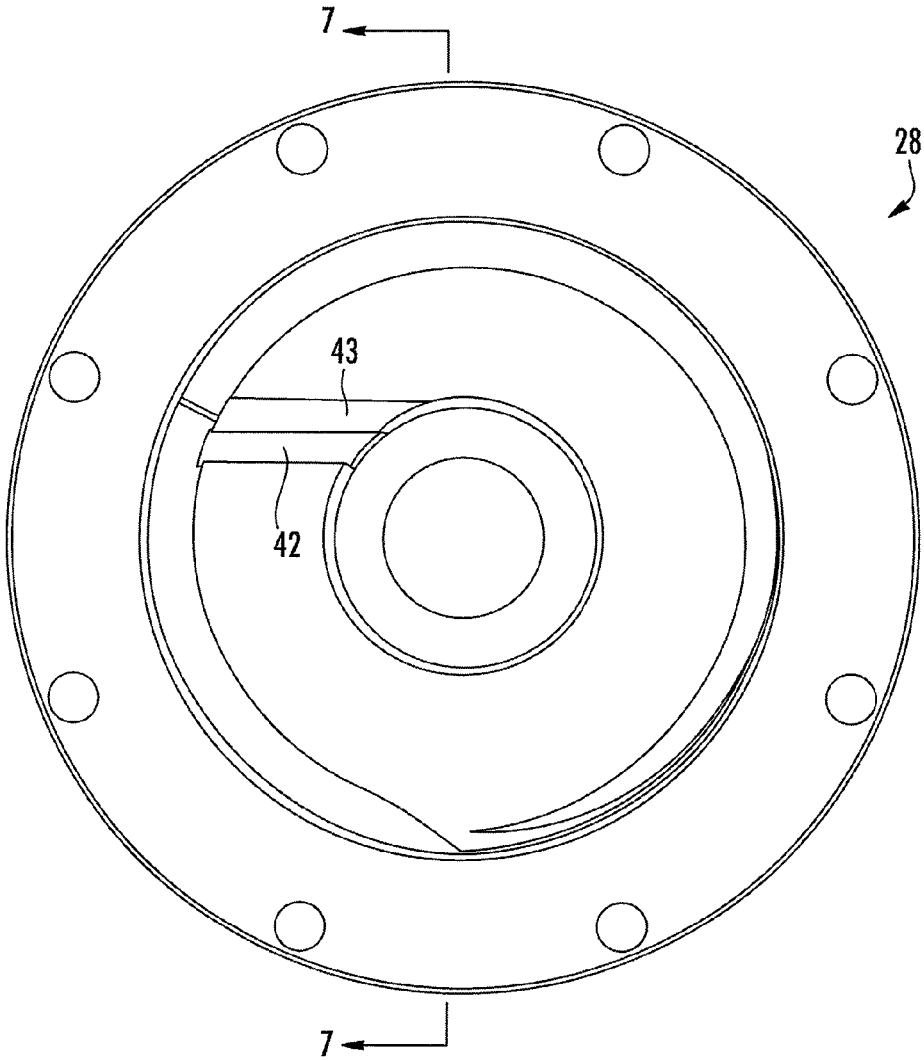
FIG. 6 is a front view of a back plate having a channel for insertion of an insert in accordance with an embodiment of the present invention.
Figure 7:
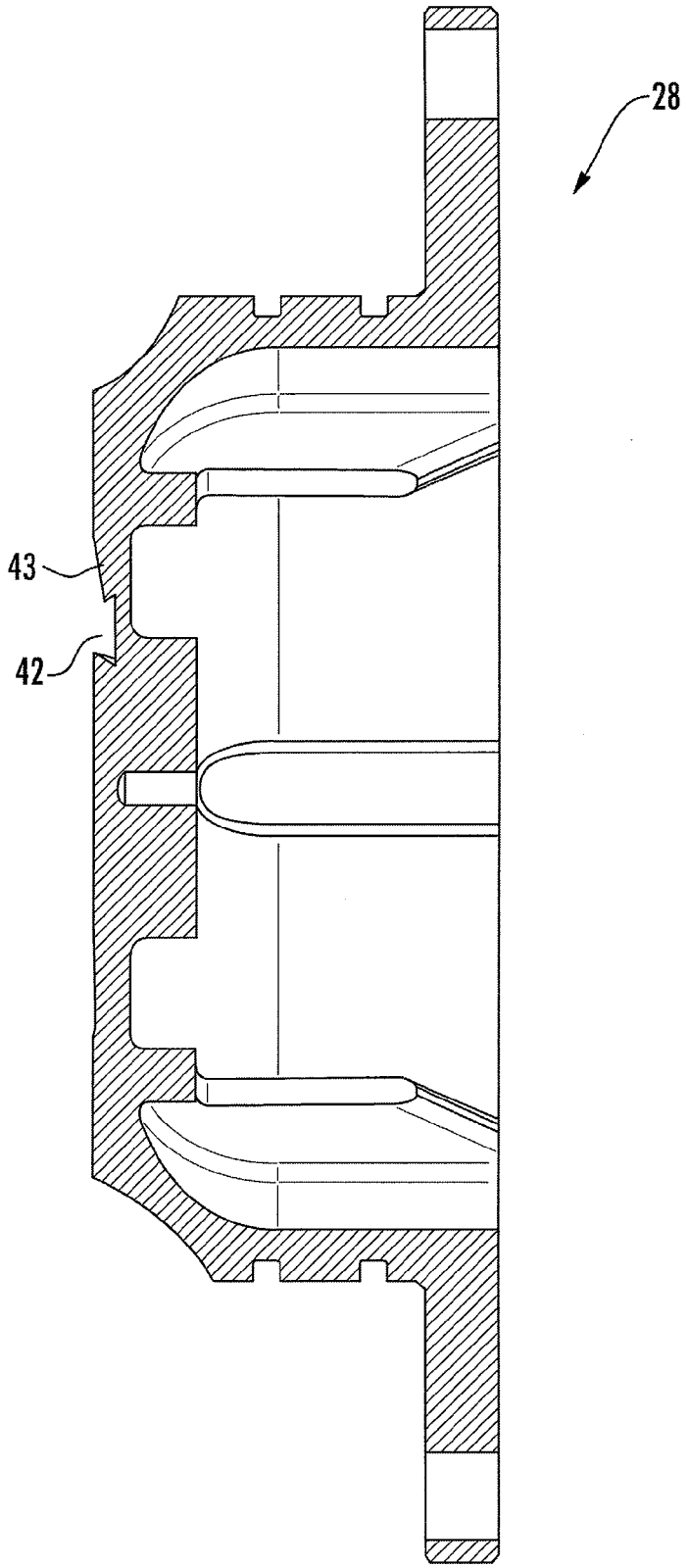
FIG. 7 is a cross-section taken along lines 7-7 of FIG. 6.
Figure 8:
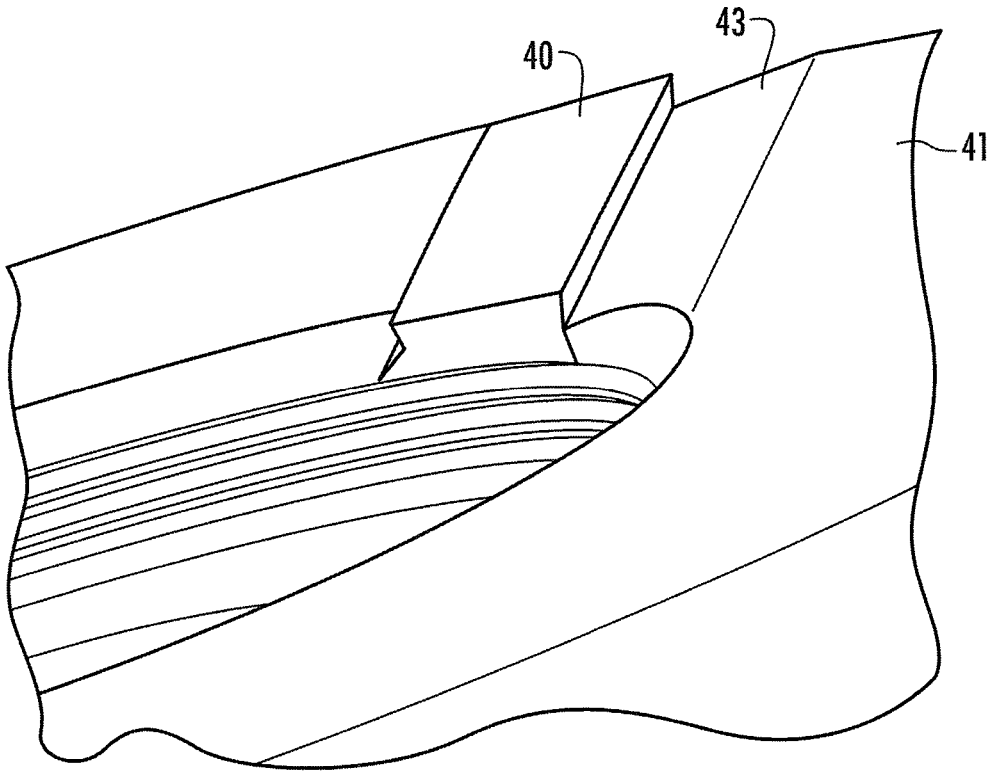
FIG. 8 is a close-up view of a cutting rib in accordance with an embodiment of the present invention.
Figure 9:
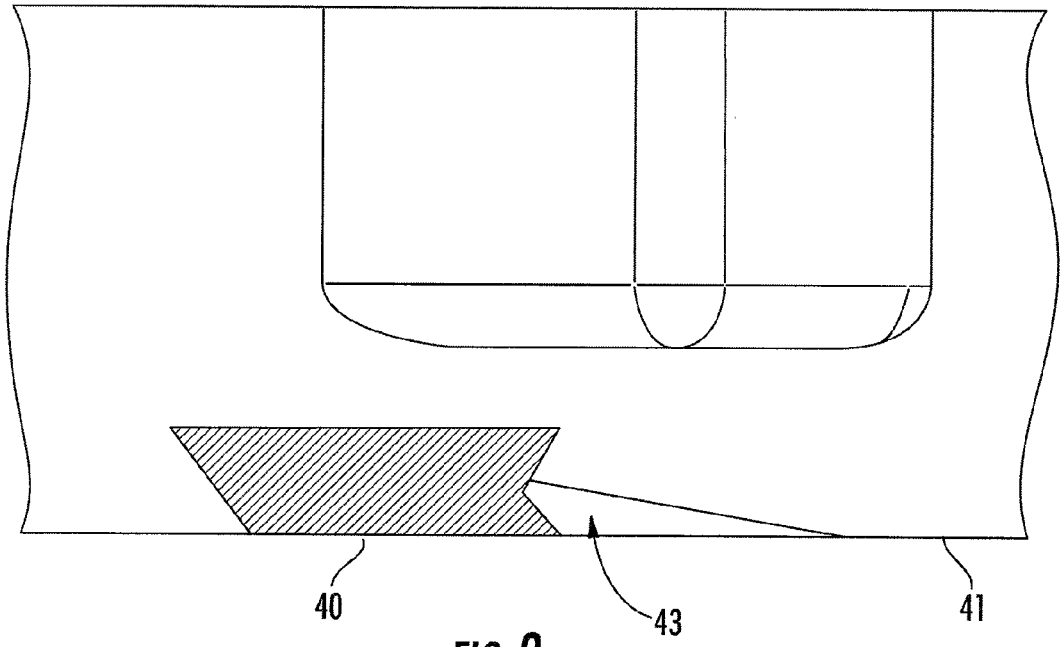
FIG. 9 is a side view of the cutting rib illustrated in FIG. 8.
Figure 10:
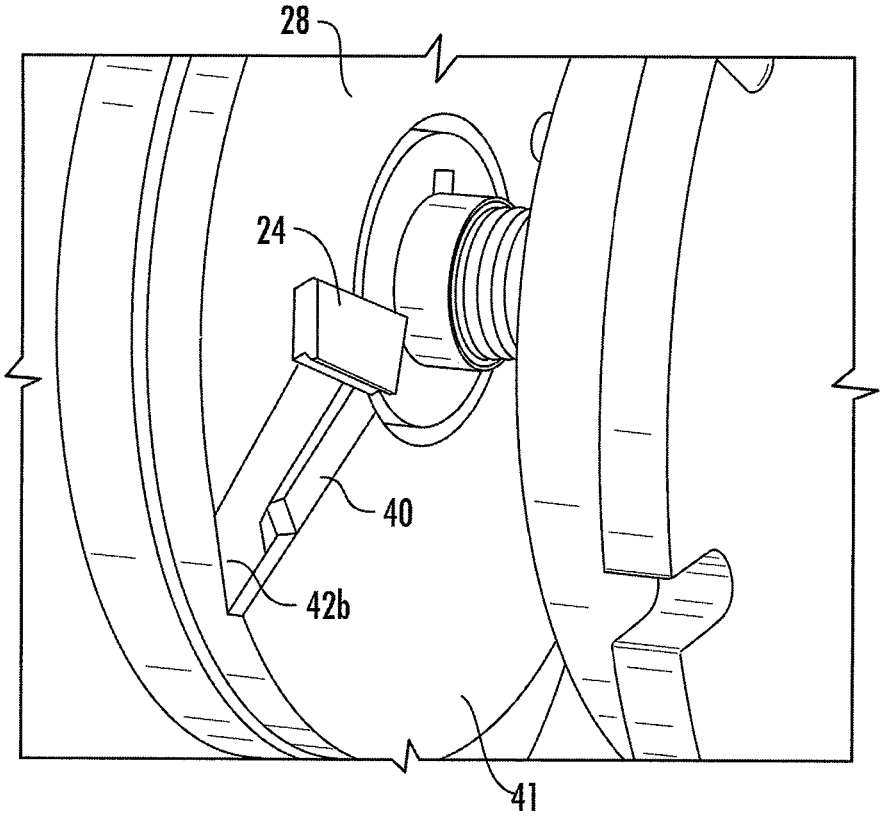
FIG. 10 is a cut-away view showing an embodiment with the impeller removed to illustrate the scissoring angle between the insert cutter and cutting rib.
Figure 11:
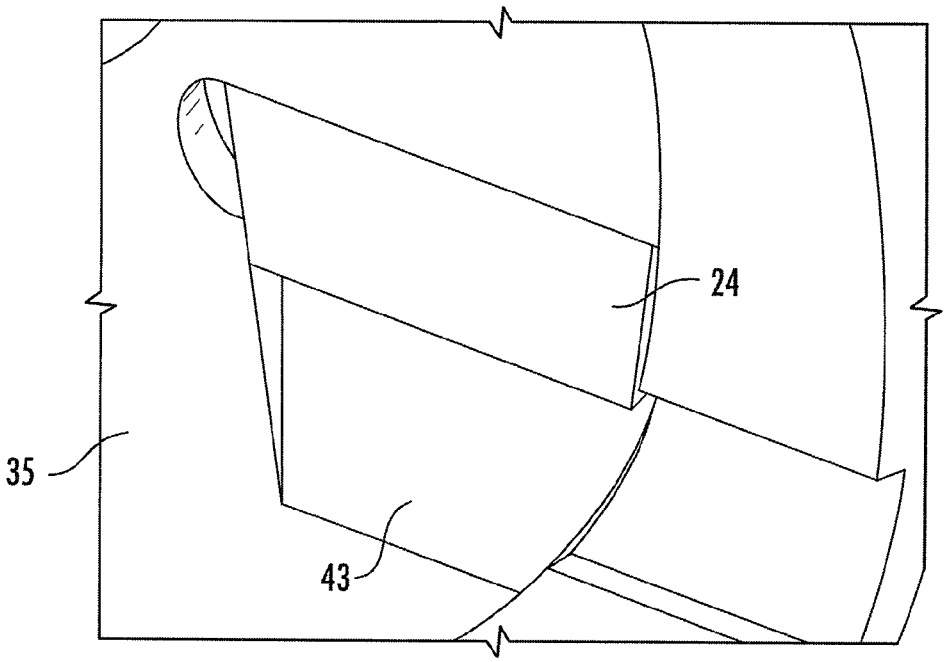
FIG. 11 is a close-up view of the insert cutter in a recess of the back shroud.
Figure 12:
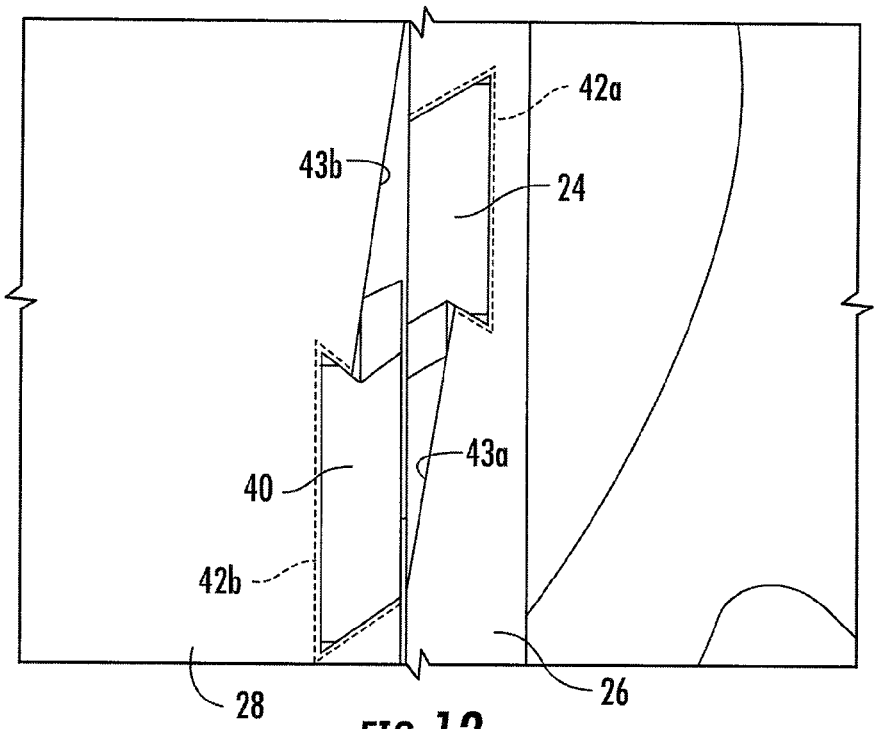
FIG. 12 is a side view illustrating the shearing relationship between an embodiment of the two cutter inserts.

As previously mentioned, and with reference to FIGS. 10-15, the insert cutter 24 is mounted to the back surface 35 of the impeller back shroud 30 where pump-out vanes would normally be located. The insert cutter 24 is preferably positioned radially, off-center on surface 35 of the shroud 30 facing the back plate 28. The shroud 30, as shown in FIGS. 4 and 11, preferably includes a dovetail groove **42*a* for insertion of the insert cutter 24 to form a first cutting area. Naturally, the groove 42*a* can be of any configuration which allows replacement of the insert cutter 24. Preferably, the groove 42*a* is cut into the surface 35 of the shroud 30 to be somewhat off-center. In some desired embodiments, the insert cutter 24 may be formed to be integral or otherwise permanent to the shroud 30. This may be accomplished by machining a cutting groove or welding a proper insert cutter 24 to the surface 35 of the shroud 30**.

Referring to FIGS. 5-10, back plate 28 is bolted at the back of the chamber 18, and includes the cutting rib 40 (or **40*b*) positioned radially, off-center on surface 41 of the plate 28** facing the insert cutter 24. The back plate 28 preferably includes a dovetail groove 42 for insertion of the back plate insert 40*a* to form cutting rib 40*b*. Naturally, the groove can be of any configuration to allow replacement of the rib. The groove 42 is cut into the surface 41 of the back plate 28 to be somewhat off-center. In some desired embodiments, the cutting rib 40*b* may be formed integral or at least permanent to the back plate 28, by machining or welding a proper insert 40*a* to the back plate. The use of an insert 40*a* allows (1) a hardened metal material to be used which is more durable than the material of the back plate, and (2) replacement of the insert when it becomes worn. The off-center positioning allows for a better cutting action between the cutting rib 40 and the insert cutter 24 as well as a better flushing path for the cut material. Also, as will be explained below, the off-center rib permits the rotating insert cutter 24 to cross the rib 40 at an effective shearing angle.

It is believed that only a single cutting rib 40 is required with most applications. However, in some instances it may be desirable or necessary to use two back plate cutting ribs. Such additional ribs may be positioned in consecutive or alternate quadrants from one another on the surface 41 of the back plate 28.

As stated above, the insert 40*a* fits tightly within a groove 42 machined into the surface 41 of the back plate 28. In addition to this friction fit within the preferably dovetailed groove 42, the cutting rib 40 should be held in place using a high-strength adhesive and retained mechanically by obstructions placed at each end of the groove 42. As the cutting rib 40 becomes worn, it can be removed and readily replaced.

As to both cutting areas 29 and 39, a sloping recessed area 43 precedes the groove 42*a* and *b* in the surface 35 of the shroud 30 and the surface 41 of the back plate 28, respectively. The sloping recessed areas 43 help to expose more of the cutting rib 40 and insert cutter 24 during the shearing action.

In addition to the sloping recessed areas 43 described above, the cutting rib 40 and insert cutter 24 are also preferably positioned such that they are flush with the respective (shroud 30 and back plate 28) surfaces. This allows the shroud 30 and back plate 28 to be positioned with tighter clearances for better pump efficiency. Solid material is directed downward into the recessed area 43 where it is impacted by the scissoring insert cutter 24 and cutting rib 40.

A gap created between the back cutting rib 40 and the insert cutter 24 is preferably within the range of from about 0.005 to about 0.050 inches (0.0127 to 0.127 cm), and most preferably in the range of from about 0.010 to 0.015 inches (0.0254 to 0.0381 cm). The gap is very important to the efficient operation of the cutting action between rib 40 and insert cutter 24. If the gap is too large, the drive motor power required may be excessive, resulting in motor overload tripping. If the gap is too narrow, metal-to-metal contact problems may result during pump operation.

Alternatively, the recessed areas described may be omitted and the upper edges of the cutting rib 40 and insert cutter 24 may be raised above the surface of the corresponding plate. In this embodiment, a necessary gap, similar to that described above, should be maintained between the cutting edges. However, a larger gap will exist between the hub shroud 30 and back plate 28 surfaces. While this configuration will negatively impact pump efficiency, it may be used with similar success in certain pump applications.

In the present embodiment, the cutting rib 40 and insert cutter 24 are preferably made of one of either a hardened steel or hardened stainless steel. As a hardened steel, the finished cutter preferably has a hardness measure of at least HRC 60, and as a hardened stainless steel, a measure of about HRC 40. Such hardness gives both the cutting rib 40 and the insert cutter 24 the necessary durability to operate effectively and efficiently before needing replacement.

As stated above, the insert cutter 24 and cutting rib 40 fit tightly within the corresponding groove 42 machined into the surfaces of the back shroud 30 and back plate 28, respectively. In addition to this close fit within the preferably dovetailed grooves 42*a* and *b*, the insert cutter 24 and cutting rib 40 should be held in place using a high-strength adhesive and may be further retained mechanically by obstructions placed at each end of the respective groove 42. As the insert 24 and rib 40 becomes worn, they may be removed and readily replaced.

In operation, liquids or slurries including solid waste material (collectively "fluid") enter the chopper pump 10 at the inlet opening 14 as a result of the suction created by the impeller 22 motion turned by motor 50. While the present system may be employed for most any chopper pump operations, it is particularly useful for small electric motor systems.

By "small motors" it is meant to include such motors rated under 30 horsepower (hp), especially those in the 5 to 10 hp range. The reason for particular application to these motors relates to the overload tendency of such motors due to the additional torque required to overcome the binding caused by solid waste gathering between the back shroud 30 and the stationary back plate 28 as previously mentioned. The disclosed invention is certainly suitable for motors of greater than 30 hp, including large pumps in the 60 to 200 hp range, but such motors are less affected by power increases and are, therefore, less susceptible to going offline due to such an increase.

Continuing, the fluid enters the chamber 18 at the first or primary cutting zone where the fluid is subjected to a first shearing action between the impeller blades 31 and the components of the cutter bar plate 26, including the internal cutter groove 37, the shear fingers 39 and also the tooth of the cutter nut 47, which cuts against the ends of the shear fingers 39. From there, most fluid travels from the chamber 18 to the outlet port opening 16. Some of the fluid ends up at the second cutting zone where it goes through another shearing action between the insert cutter 24 and the cutting rib 40 and also between the rotating impeller hub and the upper cutting ring. These components should be carefully gapped to provide the most efficient and effective cutting of difficult material—i.e., material which is not readily broken, but must be cut with scissor like action. Eventually, the fluid in the second cutting zone is also delivered to the outlet port opening 16 for discharge.

While the present invention is exclusively described herein for use on a chopper pump, the inventors concede that it may have practical uses on other types of pumps as well. For example, a raised cutting rib may be used on a screw-centrifugal pump-currently sold as TRITON® pumps by Vaughan—or on vortex (i.e., recessed impeller) pumps to pump relatively "clean" sludge in a system. By "clean" it is meant that the sludge has no large debris to be chopped by the pump. Such sludge is still replete with fine fibers, such as hair, strands of fabric and the like. The use of a cutting rib exclusively for such pump systems would be useful.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An impeller assembly for a chopper pump comprising:

an impeller having a back shroud and cutting blades sharpened on a first edge, the cutting blades extending from and fixed on a first surface of the back shroud;

an insert cutter positioned on a second surface of the back shroud opposite the impeller;

a back plate having a surface adjacent to and facing second surface of the back shroud;

a cutting rib attached to the back plate surface and configured for shearing operation in combination with the insert cutter; and an end plate having a surface adjacent to and facing the first edge of the cutting blades and having at least one shearing finger integral to the end plate for shearing operation in combination with the sharpened edge of the cutting blades of the impeller.

2. The assembly of claim 1, wherein at least one of either the cutting rib or the insert cutter is aligned radially on the surface of the back plate or the back shroud, respectively.

3. The assembly of claim 2, wherein the insert cutter is flush with a surface of the back shroud.

4. The assembly of claim 1, wherein a gap between the cutting rib and the insert cutter is in the range of from about 0.005 to 0.050 inches.

5. The assembly of claim 4, wherein the gap is in the range of from about 0.010 to about 0.015 inches.

6. The assembly of claim 4, wherein the gap is adjustable.

7. The assembly of claim 1, wherein both the cutting rib and the insert cutter are comprised of one of either hardened stainless steel or hardened steel.

8. The assembly of claim 7, wherein both the cutting rib and the insert cutter are comprised of hardened steel having a hardness measure of at least HRC 60.

9. The assembly of claim 7, wherein both the cutting rib and the insert cutter are comprised of hardened stainless steel having a hardness measure of about HRC 40.

10. The assembly of claim 1, wherein the cutting rib is detachable from the back plate surface to allow replacement of the cutting rib.

11. The assembly of claim 1, wherein the back plate comprises a plurality of cutting ribs attached thereto.

12. The assembly of claim 1, wherein the surface of the back shroud comprises a recessed area and a single insert cutter is attached within the recess.

13. The assembly of claim 1, wherein the insert cutter is detachable from the back shroud surface to allow replacement of the insert cutter.

14. A chopper pump comprising:

a housing having an intake opening and an outlet opening, both in fluid communication with an internal chamber; and an impeller assembly positioned within the chamber and comprising:

cutting blades sharpened on a first edge fixed to and extending from a first surface of an impeller back shroud;

an insert cutter positioned on a second surface of the back shroud opposite the impeller;

a cutter bar plate having a surface adjacent to and facing the first edge of the cutting blades and at least one of either a shearing finger and an internal cutting bar fixed to the cutter bar plate for cooperating with the cutting blades to define a first zone; and a back plate having a surface adjacent to and facing the insert cutter and a cutting rib attached to the back plate surface, the cutting rib and the insert cutter cooperating to define a second zone;

wherein material entering the intake opening of the housing passes into the chamber where it is subject to shearing action in at least one of either the first zone and the second zone before being discharged through the outlet opening.

15. The chopper pump of claim 14, wherein the surface of the back plate comprises a recessed area and a single cutting rib is attached within the recess.

16. The chopper pump of claim 15, wherein the cutting rib is raised above the surface of the back plate to cut against the insert cutter.

17. The chopper pump of claim 14, wherein the at least one cutting rib is detachable from the surface to allow replacement of the cutting rib.

18. The chopper pump of claim 14, wherein a gap between the cutting rib and the insert cutter in the second zone is in the range of from about 0.005 to 0.050 inches.

19. The chopper pump of claim 18, wherein the gap is in the range of from about 0.010 to about 0.015 inches.

* * * * *